United States Patent [19]

Stenger et al.

[11] 4,180,974

[45] Jan. 1, 1980

[54] COMBUSTOR DOME SLEEVE

[75] Inventors: Richard E. Stenger, Cincinnati; Edward E. Ekstedt, Montgomery; Stanford P. Seto, Loveland, all of Ohio

[73] Assignee: General Electric Company, Cincinnati, Ohio

[21] Appl. No.: 847,459

[22] Filed: Oct. 31, 1977

[51] Int. Cl.[2] ..... F02C 7/00

[52] U.S. Cl. ..... 60/39.71; 60/39.74 R

[58] Field of Search ..... 60/39.71, 39.74 R; 239/399, 402, 403, 404, 405, 406

[56] References Cited

U.S. PATENT DOCUMENTS

| | | | |
|---|---|---|---|
| 3,853,273 | 12/1974 | Bahr et al. | 60/39.74 R |
| 3,866,413 | 2/1975 | Sturgess | 60/39.74 R |
| 3,905,192 | 9/1975 | Pierce et al. | 60/39.71 |
| 3,946,552 | 3/1976 | Weinstein et al. | 60/39.74 R |
| 3,972,182 | 8/1976 | Salvi | 60/39.74 R |

*Primary Examiner*—Louis J. Casaregola

*Attorney, Agent, or Firm*—Dana F. Bigelow; Derek P. Lawrence

[57] ABSTRACT

In a combustor carburetor device having a secondary swirler which axially introduces airflow between the venturi and a splashplate, a cylindrical sleeve is inserted between the venturi and the splashplate to axially extend the air outer flow path. The cavity defined by the axial extension and the splashplate is then purged by a source of air such that the combination prevents the flow of fuel from the venturi to the surface of the splashplate to thereby reduce emissions during engine idle operation. At the downstream end of the cylindrical sleeve is attached a frustoconical portion which allows controlled dispersion of the fuel/air mixture for resultant improved ignition characteristics.

15 Claims, 5 Drawing Figures

Fig 1
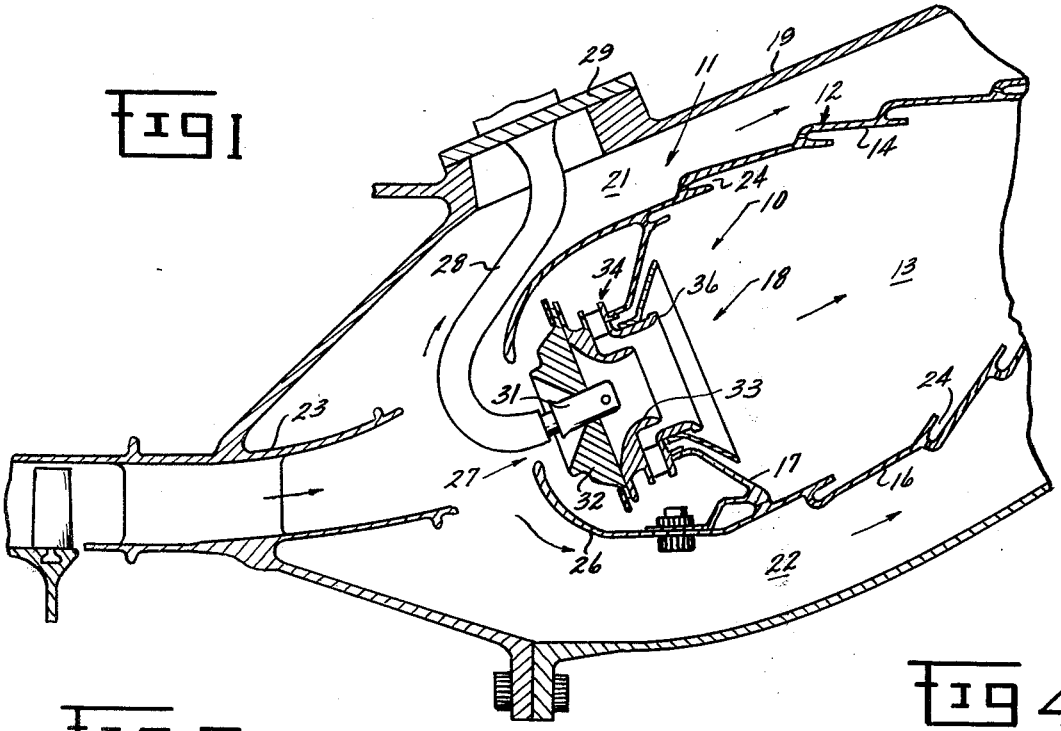
Fig 2
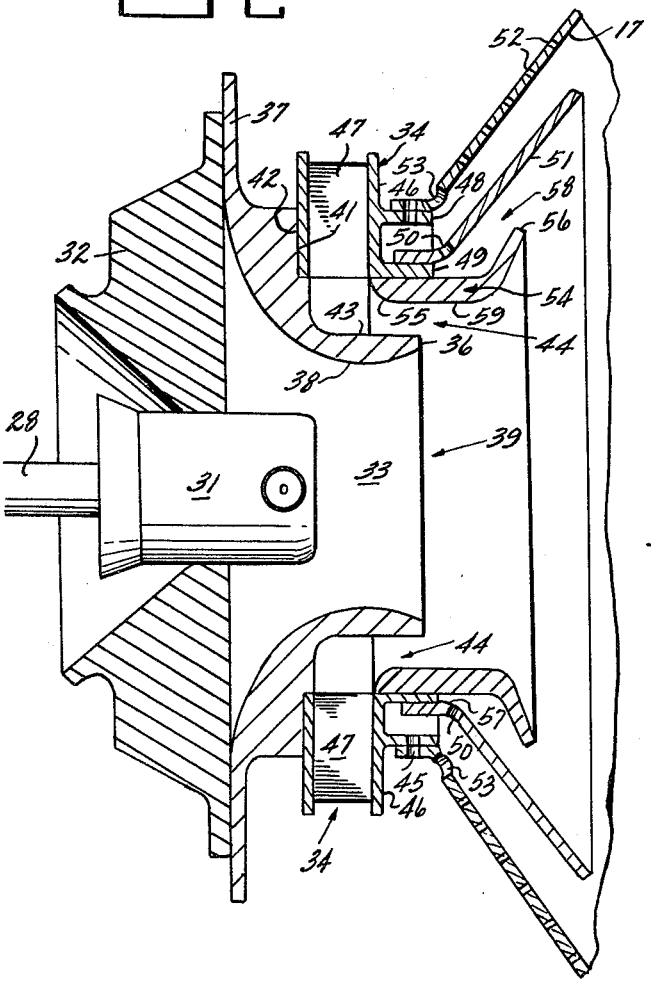
Fig 4
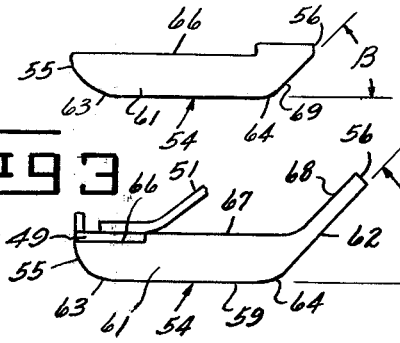
Fig 3
Fig 5
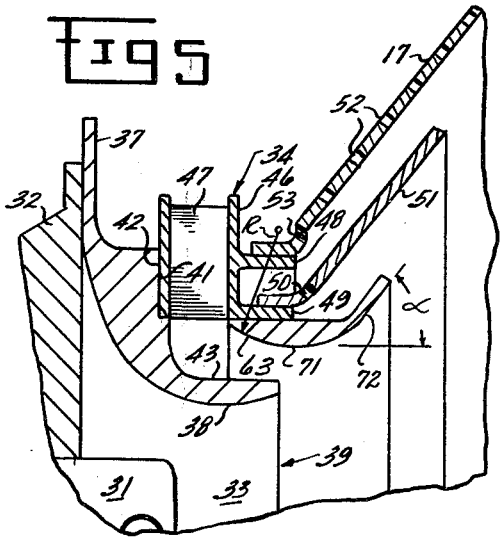

COMBUSTOR DOME SLEEVE

The invention herein described was made in the course of or under a contract, or a subcontract thereunder, with the United States Department of the Air Force.

BACKGROUND OF THE INVENTION

This invention relates generally to carburetor devices and, more particularly, to gas turbine engine combustion systems having central fuel injectors.

In the design of gas turbine engines, it has become important to not only provide for a combustor apparatus which is efficient, but also one which tends toward complete combustion with a minimum of emissions. Since operation of the engine while on the ground is more critical to the environment, and since the idle condition of operation tends to produce a higher level of emissions, it is the condition of operation which is of greater concern.

Because of various problems associated with high pressure fuel spray atomizers, the use of low pressure fuel injection systems has become more attractive. In such a low pressure system, counterrotational primary and secondary swirler vanes are employed to efficiently atomize the fuel by the high shear forces developed at the confluence of the counterrotational airstreams. The most common counterrotational system employs, in the primary stage, an axial swirler where the air enters in an axial direction, is deflected in a somewhat circumferential direction to introduce a swirl to the airflow, and then flows axially downstream within the venturi where it finally mixes and interacts with the air from the counterrotational secondary swirler. In other words, in the primary swirler the fuel and air are mixed to generate an angular spray pattern which is generally wide in form. The secondary swirler, which initially introduces air radially inward, to flow then in a generally axial direction, has a high momentum and swirl angle and tends to increase the discharge spray angle, slinging the fuel spray radially outward when it interacts with the mixed stream from the primary swirler. The resulting wide angle spray pattern (150°–180°) tends to allow liquid fuel deposits on the conical-shaped splashplate, which deposits tend to flow across the splashplate to the combustor liner where they join with the cooling air film and are carried through the combustor without totally burning. This, of course, results in high emission levels at the exhaust.

It has been proposed to place a sleeve at the splashplate inner radius so as to control the fuel dispersion and prevent the flow of fuel radially outward to the splashplate. However, this tends to create a low pressure cavity area between the sleeve and the splashplate, which in turn causes cavitation of the fuel/air mixture flow. This brings about not only a deposit of fuel on the splashplate as discussed hereinabove, but the occurrence of hot spots and localized burning of the splashplate.

Accordingly, a primary objective of this invention is the provision for an improved carburetion system which provides for efficient and low emission combustion of fuel.

Another object of this invention is the provision in a combustor for eliminating the entry of fuel particles to the liner cooling air film.

Yet another object of the present invention is the provision in a combustor carburetor device for preventing the deposit of liquid fuel particles on the splashplate structure thereof.

Still another object of the present invention is the provision in a combustor carburetor liner for controlling the effective spray angle in the combustor dome.

Yet another object of the invention is the provision in a combustor carburetor dome for preventing localized burning of the splashplate.

A further object of the present invention is the provision for a combustor dome apparatus which is economical to manufacture and efficient in operation.

These objects and other features and advantages become more readily apparent upon reference to the following description when taken in conjunction with the appended drawings.

SUMMARY OF THE INVENTION

Briefly, in accordance with one aspect of the invention, a cylindrical sleeve is placed at the downstream end of the secondary swirler to define the outer flow path of the axial passage through which the secondary airflow is passed. The sleeve effectively extends the axial length of the flow path to a point beyond that in which the splashplate commences to diverge, to thereby narrow the angular spray pattern and prevent the deposit of fuel particles on the splashplate surface. The cavity defined by the splashplate and the sleeve is then purged by a source of air to prevent the flow of fuel thereto. In this way, all of the liquid fuel particles remain within the combustion zone for complete combustion.

By another aspect of the invention, the cylindrical sleeve has on its downstream end, a frustoconical section which diverges outwardly toward its downstream end to allow the controlled dispersion of the fuel spray without attendant attachment of fuel particles to the splashplate. These controlled wider spray angles provide for improved ignition characteristics and exit temperature profiles due to the improved uniformity in dome fuel/air ratios.

By yet another aspect of the invention, the sleeve is cooled by the use of cooling air which is introduced by a plurality of circumferentially spaced holes in the splashplate and subsequently impinges on, and flows along, the outer surface of the insert to effect cooling thereof.

In the drawings as hereinafter described, a preferred embodiment is depicted; however, various other modifications and alternate constructions can be made thereto without departing from the true spirit and scope of the invention.

BRIEF DESCRIPTION OF THE DRAWING

FIG. 1 is an axial cross-sectional view of a combustor with its dome modified in accordance with the present invention.

FIG. 2 is an enlarged view of the carburetor dome portion thereof.

FIG. 3 is a schematic illustration of the carburetor portion thereof with a sleeve in accordance with the preferred embodiment of the invention.

FIGS. 4 and 5 are schematic illustrations of the carburetor portion thereof with modified embodiments of the sleeve element.

DESCRIPTION OF THE PREFERRED EMBODIMENT

Referring to the drawings, and particularly to FIG. 1, the invention is shown generally as applied to a continuous-burning combustion apparatus 11 of the type suitable for use in a gas turbine engine and comprising a hollow body 12 defining a combustion chamber 13 therein. The hollow body 12 is generally annular in form and is comprised of an outer liner 14, an inner liner 16 and a domed end or dome 17. It should be understood, however, that this invention is not limited to such an annular configuration and may well be employed with equal effectiveness in combustion apparatus of the well-known cylindrical can or cannular type. In the present annular configuration, the domed end 17 of the hollow body 12 is formed with a plurality of circumferentially spaced openings 18, each having disposed therein an improved combustion apparatus of the present invention 10 for the delivery of an air/fuel mixture into the combustion chamber 13.

The hollow body 12 may be enclosed by a suitable shell 19 which, together with the liners 14 and 16, defines passages 21 and 22, respectively, which are adapted to deliver the flow of pressurized air from a suitable source such as a compressor (not shown) and a diffuser 23, into the combustion zone 13 through suitable apertures or louvers 24 for cooling of the hollow body 12 and dilution of the gaseous products of combustion in a manner well known in the art. The upstream extension 26 of the hollow body 12 is adapted to function as a flow splitter, dividing the pressurized air delivered from the compressor between the passages 21 and 22 and an upstream end opening 27 of the extension 26. The opening 27 fluidly communicates with the improved carburetion device of the present invention 10 to provide the required air for carburetion.

Delivery of fuel to the fuel injection apparatus is provided by way of a hollow fuel tube 28 which is connected to the outer shell 19 by means of a mounting pad 29. The fuel tube 28, which is curved to fit within the opening 27, comprises a piece of hollow tubing having a fuel passageway formed therein which supplies liquid fuel for the fuel injector tip 31 for subsequent atomization by the carburetor device of the present invention.

The carburetor device is shown to include, in serial interrelationship, an air blast disk 32, a venturi shroud 33 and a secondary swirler 34. Specific structure and operation of the air blast disk 32 and the fuel injector tip 31 can be had by reference to patent application Ser. No. 644,940, field on Dec. 24, 1975 by Stenger et al (now U.S. Pat. No. 4,070,826) and assigned to the assignee of the present invention. Briefly, carburetion of the fuel from the injector tip 31 for subsequent introduction into the combustor 13 is accomplished by initially directing a plurality of high pressure air jets on the low pressure fuel stream emanating from ports in the fuel injector tip 31 to partly break up the liquid particles of fuel and create a counterclockwise swirling of the atomized mixture within the venturi shroud 33. The swirling mixture, which also has an axial component of velocity, tends to flow out of the downstream lip 36 of the venturi shroud 33 where it interacts with the counterrotational or clockwise rotating swirl of air being delivered by the secondary swirler 34. The interaction between the two airstreams provides a region of high shear forces which act to finely atomize fuel swirling out of the venturi shroud 33 to prepare it for ignition within the combustor 13.

Referring to FIG. 2, the venturi shroud 33 converges from a flange portion 37 thereof to a point of minimum radius or a throat 38, and then diverts slightly to the downstream lip 36 to define a central aperture 39 through which the fuel/air mixture may be counterrotationally swirled into the active zone of the secondary swirler 34. On the outer side of the venturi shroud 33 there is formed a flat face 41 for attachment to the forward wall 42 of the secondary swirler 34 to derive support therefrom. The flat face then quickly transitions to an axially aligned outer wall 43 which forms the inner boundary for the axial flow path 44 from the secondary swirler 34. The secondary swirler 34 includes, in addition to the forward wall 42, an axially spaced aft wall 46 and a pluarlity of counterrotatable radial vanes 47 disposed between the walls 42 and 46 so as to cause the flow of high pressure air in first the radial inward direction and then to be turned by the axially aligned outer wall 43 to flow in the axial direction with clockwise swirl. Support for the secondary swirler 34 is provided by an annular flange 48 extending rearwardly thereof and attached to the dome end 17 by way of brazing or the like. A secondary exit lip 49 comprises an axially aligned annular flange disposed radially inward from the first annular flange 48 and has attached thereto, at the radially outer side thereof, a flared trumpet outlet or splashplate 51 which extends into the combustion chamber 13 as shown in FIG. 2. Cooling of the splashplate may be accomplished by the impingement of cooling air on the upstream side thereof from a plurality of holes 52 formed in the domed end 17 as shown. Further, a plurality of circumferentially spaced holes 45 and 53 are formed at the inner radius and at the radially inward edge of the domed end 17, respectively, to provide a source of air to the holes 50 at the radially inward edge of the splashplate for purging as will be more fully described hereinafter.

Disposed in close-fit relationship with the inner side of the secondary exit lip 49 is an annular sleeve 54 which extends generally in an axial direction from its one end 55 adjacent the secondary swirler aft wall 46 to its downstream end 56. As can be seen, the annular sleeve 54 extends downstream well beyond the point 57 in which the splashplate begins to flare out to thereby define, with the splashplate, a wedge-shaped cavity 58. The annular sleeve 54, with its internal wall 59, tends to narrow the axial flow path 44 and extends its axial length to a point intermediate the ends of the flared portion of the splashplate to thereby narrow the effective spray angle from the dome asembly and prevent the migration of liquid fuel particles to the surface of the splashplate where they might otherwise migrate to the combustor liner walls without being ignited.

Referring now to FIG. 3, the annular sleeve 54 is shown to include, in addition to the axially extending portion 61, a diverging portion 62 which is disposed at an angle $\alpha$ with the central axis. It has been found experimentally that this angle is preferably in the range of 30°–50° for best performance. In particular, this so-called "wide-angled" sleeve has been found to perform well in the execution of air starts. Since the annular sleeve 54 forms the outer boundary of the axial flow path 44 from the secondary swirler 34, it is preferred that near the forward end 55, a rounded leading edge 63 be provided to promote desirable airflow characteristics. Similarly, at the transistion between the axial portion 61 and the diverting portion 62, a rounded edge 64 is also provided. This curved surface is critical in that an abrupt sharp corner would bring about flow separation from the surface and resultant disruption of the flow pattern. That is, as the flow turns it tends to speed up and create a surface static pressure gradient which changes at a rate determined by the radius of the turn. The radius must therefore be large enough to allow the flow to turn the corner without causing random local separation from the sleeve surface. It will be recognized by one skilled in the art that the radii of these rounded edges 63 and 64 may be varied to accommodate the particular design and performance characteristics desired. On the outer side of the annular sleeve 54 an indented surface 66 is provided for closely fitting on the inside of the secondary exit lip 49 of the secondary swirler 34. A second step surface 67 is preferably of a diameter such that the surface closely engages the inner side of the axial portion of the splashplate 51. The outer surface 68 of the diverting portion 62 is preferably disposed at or near the same angle $\alpha$ as the opposite wall as shown, and this may be, but is not necessarily, parallel to the wall of the splashplate 51.

Referring now to FIG. 4, an alternate embodiment of the annular sleeve 54 is shown to include an axial portion 61 but no diverting portion. Instead, the rounded edge 64 near the downstream end 56 quickly transitions to a planar surface 69 which is disposed at an angle $\beta$ with the central axis. In this so-called "cylindrical" version of the annular sleeve, the angle $\beta$ has preferably been found to be within the range of 30°–90°. Again, the indented surface 66 is of a diameter which facilitates a close-fit relationship on the inner side of the secondary exit lip 49.

Referring now to FIG. 5, another alternative embodiment of the annular sleeve is shown wherein the inner side thereof comprises a curvilinear portion 71 and a planar portion 72. The curvilinear portion 71 has a substantially constant radius R and extends from the forward rounded edge 63 to the planar portion 72 to present a slightly diverging profile as shown. The planar portion 72 is disposed at an angle $\alpha$ similar to the embodiment as shown in FIG. 3.

With the introduction of any of the above-described sleeves, a low pressure region is created in the cavity 58 which, if allowed to remain, will cause a flow cavitation and localized burning of the splashplate. Accordingly, the holes 50 are provided to introduce a flow of cooling air through the cavity 58 to purge it from any fuel particles which may tend to collect there. In addition, this air flows on the outer side of the sleeve to cool it by impingement and by film cooling processes.

It will be understood that the present invention has been described in terms of particular embodiments, but may take any number of other forms while remaining within the scope and intent of the invention.

Having thus described the invention, what is claimed as novel and desired to be secured by Letters Patent of the United States is:

1. An improved combustor dome assembly of the type having a fuel injector, a venturi, a primary swirler, a secondary swirler and a splashplate closely spaced from a dome, wherein the secondary swirler introduces a flow of air in a generally axial direction between the venturi and the splashplate, and a portion of the splashplate is disposed at an acute angle to this axis, comprising:

a sleeve disposed between the venturi and the splashplate, said sleeve extending axially downstream further than the venturi and having a portion which is substantially axially disposed to form on its inner side the outer flow path of the flow of air from the secondary swirler, and on its outer side a downstream diverging cavity with the splashplate angled portion; and means for purging said cavity with air.

2. An improved combustor dome assembly as set forth in claim 1 wherein said sleeve indludes a downstream portion which is disposed at a downstream diverging angle to the axes.

3. An improved combustor dome assembly as set fort in claim 2 wherein said angle is in the range of 30°–50°.

4. An improved combustor dome assembly as set forth in claim 1 wherein said purging means comprises a plurality of holes formed in the inner radius of the splashplate for introducing a flow of air into said cavity.

5. An improved combustor dome assembly as set forth in claim 4 and including a domed end located radially outside of the splashplate and further wherein said purging means also includes a plurality of holes formed in the inner radius of said domed end.

6. An improved combustor dome assembly as set forth in claim 1 and including cooling means for introducing the flow of cooling air on the outer side of said sleeve.

7. An improved combustor dome assembly as set forth in claim 6 wherein said cooling means comprises a plurality of circumferentially spaced holes formed in the splashplate.

8. An improved combustor dome assembly of the type comprising a venturi, a fuel injector disposed axially therein, a primary swirler for introducing air into the venturi and passing a fuel/air mixture downstream thereof, secondary swirler surrounding said venturi for introducing a flow of air in the downstream direction, and a splashplate connected to the secondary swirler in close spaced relationship to a dome, comprsing:

a cylindrical sleeve connected to the secondary swirler and having a portion which extends axially downstream further than the venturi to be circumscribed by at least a portion of the splashplate to mutually define a cavity therebetween, and which defines on its inner surface the outer flow path of the airflow from the secondary swirler; and means for purging said cavity with air.

9. An improved combustor dome assembly as set forth in claim 8 wherein said cylindrical sleeve includes a downstream portion which is disposed at a downstream diverging angle to the axis.

10. An improved combustor dome assembly as set forth in claim 9 wherein said angle is in the range of 30°–50°.

11. An improved combustor dome assembly as set forth in claim 8 wherein said purging means comprises a plurality of holes formed in the inner radius of the splashplate for introducing a flow of air into said cavity.

12. An improved combustor dome asembly as set forth in claim 11 and including a domed end located radially outside of the splashplate and further wherein said purging means also includes a plurality of holes formed in the inner radius of said domed end.

13. An improved combustor dome assembly as set forth in claim 8 and including cooling means for introducing the flow of cooling air on the outer side of said sleeve.

14. An improved combustor dome assembly as set forth in claim 9 wherein said cooling means comprises a plurality of cooling holes formed in the splashplate.

15. An improved combustor dome as set forth in claim 2 wherein, on said sleeve inner side, the surface transition between said substantially axially disposed portion and said downstream portion is curvilinear.

* * * * *